US007632152B2

(12) United States Patent
Ho et al.

(10) Patent No.: US 7,632,152 B2
(45) Date of Patent: Dec. 15, 2009

(54) DC/AC ADAPTER ASSEMBLY WITH A POWER-OVERLOAD PROTECTION CIRCUIT

(75) Inventors: Lien-Hsun Ho, Taipei (TW); Yuan-Liang Hsu, Taipei (TW); Shou-Ting Yeh, Taipei (TW); Chuan-Hsing Wu, Taipei (TW); Grant Chen, Taipei (TW)

(73) Assignee: Cyber Power System Inc. (TW)

( * ) Notice: Subject to any disclaimer, the term of this patent is extended or adjusted under 35 U.S.C. 154(b) by 428 days.

(21) Appl. No.: 11/604,281

(22) Filed: Nov. 27, 2006

(65) Prior Publication Data

US 2008/0123376 A1 May 29, 2008

(51) Int. Cl.
*H01R 25/00* (2006.01)

(52) U.S. Cl. ..... 439/638

(58) Field of Classification Search ..... 439/638
See application file for complete search history.

(56) References Cited

U.S. PATENT DOCUMENTS

2005/0099142 A1* 5/2005 Cottongim et al. ..... 315/309

* cited by examiner

*Primary Examiner*—Tho D Ta
(74) *Attorney, Agent, or Firm*—Hershkovitz & Associates, LLC; Abraham Hershkovitz

(57) ABSTRACT

A DC/AC adapter assembly has a DC/AC adapter and a cable. The cable transmits a power-overloading signal to the DC/AC adapter indicating whether power-overloading is occurring in the cable. The DC/AC adapter includes a controller circuit for controlling and adjusting an output alternating current of the DC/AC adapter based on the power-overloading signal to reduce power-overloading occurring in the cable.

14 Claims, 9 Drawing Sheets

DC/AC ADAPTER ASSEMBLY WITH A POWER-OVERLOAD PROTECTION CIRCUIT

BACKGROUND OF THE INVENTION

1. Field of Invention

The present invention relates to a DC/AC adapter assembly, and more particularly to a DC/AC adapter assembly with a power-overload protection circuit.

2. Description of the Related Art

Power sources of an automobile include an automotive battery and a cigarette lighter outlet. In the past, a cigarette lighter was provided in an automobile for drivers and passengers who are smokers. More recently, smokers have avoided smoking in cars for health and safety reasons. Although the cigarette lighter is not often used to light cigarettes, a cigarette lighter outlet in the automobile is often used to provide electricity to an electrical appliance such as a laptop, a personal digital assistant (PDA), a mobile phone, or the like.

FIGS. 6 and 7 illustrate a conventional DC/AC adapter assembly 54 having a DC/AC adapter 40 and a cable 50. The DC/AC adapter 40 is configured to receive input DC electricity, which may have 150-watts or 200-watts of electrical power, through the cable 50. The DC/AC adapter 40 has an enclosure 42, a circuit board (not shown) and a socket 41. The circuit board is mounted in the DC/AC adapter 40 for transforming the input DC electricity to AC electricity (110V/220V). The socket 41 is mounted in a side 43 of the enclosure 42 and has a contact (not shown). The contact is mounted in the socket 41 and is connected with the circuit board.

The cable 50 is used to connect the DC/AC adapter 40 with a cigarette lighter outlet of an automobile. A connector 51 is mounted to a proximal end of the cable 50 and a plug 52 is mounted to a distal end of the cable 50. The plug 52 plugs into the socket 41 and makes contact with the contact of the socket 41. The connector 51 connects with a cigarette lighter outlet of the automobile to allow DC electricity having an electrical power of up to 150-watts to flow from the cigarette lighter outlet through the cable 50 into the DC/AC adapter 40.

FIGS. 8 and 9 illustrate a conventional DC/AC adapter assembly 64 having the DC/AC adapter 40 and a cable 60. The cable 60 is used to connect the DC/AC adapter 40 with an automotive battery. Crocodile clips 61 are mounted to a proximal end of the cable 60 and a plug 62 is mounted to a distal end of the cable 60. The plug 62 plugs into the socket 41 and makes contact with the contact (not shown) of the socket 41. The crocodile clips 61 are connected to an automotive battery to allow DC electricity having an electrical power of 200-watts to flow from the battery through the cable 60 into the DC/AC adapter 40.

The DC/AC adapter 40 is configurable to receive input DC electricity having an electrical power of 150-watts through the cable 50 or input DC electricity having an electrical power of 200-watts through the cable 60. If the DC/AC adapter 40 is configured to receive 200-watts of electricity, the connector 51 of the cable 50 is connected to a cigarette lighter outlet, and the plug 52 of the cable 50 is plugged into the DC/AC adapter 40, the current flowing through the cable 50 into the DC/AC adapter 40 will overload the cable 50. As a result, the cable 50 may become damaged or users of the DC/AC adapter 40 may become injured.

In light of the above, a need exists for reducing the occurrence of power-overloading in a DC/AC adapter assembly.

SUMMARY OF THE INVENTION

In various embodiments, the present invention provides a DC/AC adapter assembly having an adapter and a cable. The adapter receives a direct current (DC) and a power-overloading signal from the cable and adjusts an output alternating current (AC) of the DC/AC adapter based on the power-overloading signal to inhibit power overloading from occurring in the DC/AC adapter assembly.

In one embodiment, the DC/AC adapter has a circuit board and a socket. The circuit board is mounted in the DC/AC adapter and has a controller circuit. The controller circuit is mounted on the circuit board for controlling and adjusting the output current of the DC/AC adapter. The socket is mounted in an enclosure of the DC/AC adapter and has one or more contacts. The contacts are mounted in the socket and are connected with the circuit board. One of the contacts of the socket is a detector contact that is connected with the controller circuit. A connector is mounted to a proximal end of the cable and a plug is mounted to a distal end of the cable. The connector connects the cable to a power source and the plug detachably plugs into the socket. The plug has one or more contacts corresponding to the contacts of the socket, which are configured to receive the corresponding contacts of the socket. One of the contacts of the plug is a detector contact that is configured to contact the detector contact of the socket for transmitting the power-overloading signal from the cable to the DC/AC adapter. If the power-overloading signal indicates power-overloading occurring in the cable, the controller circuit adjusts the output alternating current of the DC/AC adapter to reduce the input direct current. Reducing the input direct current inhibits power-overloading from occurring in the cable and the DC/AC adapter. In this way, damage to the elements of the DC/AC adapter assembly is reduced or prevented.

A DC/AC adapter assembly, in accordance with one embodiment, includes a DC/AC and a cable. The DC/AC adapter has a circuit board mounted in the adapter and a controller circuit mounted on the circuit board. The controller circuit is configured to control and adjust an output current of the DC/AC adapter. The DC/AC adapter also has a socket mounted in the adapter. The socket has a first plurality of contacts aligned in the socket. The first plurality of contacts is connected with the circuit board. One of the contacts of the first plurality of contacts is a detector contact that is connected with the controller circuit. The cable is configured to connect to the adapter and to a power source. The cable includes a connector at a proximal end of the cable. The connector is configured to connect to the power source. The cable also has a plug at a distal end of the cable. The plug is configured to detachably plug into the socket and to send a power-overloading signal to the socket when an electric power of the electricity on the cable exceeds a predetermined maximum load. The plug has a second plurality of contacts corresponding to the first plurality of contacts. The second plurality of contacts is configured to contact the first plurality of contacts. A detector contact of the second plurality of is configured to contact the detector contact of the first plurality of contacts for transmitting the power-overloading signal from the cable to the socket when the electric power of the electricity on the cable exceeds the predetermined maximum load.

A DC/AC adapter assembly, in accordance with one embodiment, includes a DC/AC adapter and a cable. The DC/AC adapter includes a controller circuit configured to control an output alternating current of the DC/AC adapter. The cable is configured to connect to the DC/AC adapter and to a power source. The cable is further configured to transmit electrical power from the power source to the AC/DC adapter and to transmit a signal to the DC/AC adapter indicating whether power-overloading is occurring in the cable. The controller circuit is further configured to adjust the output alternating current based on the signal.

A DC/AC adapter assembly, in accordance with one embodiment, includes a DC/AC adapter assembly and a cable. The DC/AC adapter includes a controller circuit configured to control an output alternating current of the DC/AC adapter. The cable is configured to connect to the DC/AC adapter and to a power source. The cable is further configured to transmit an input direct current from the power source to the AC/DC adapter and to transmit a signal to the DC/AC adapter based on the input direct current. The signal indicates whether the input direct current exceeds an input current threshold. The controller circuit is further configured to adjust the output alternating current based on the signal to reduce the input direct current.

Other advantages and novel features of the invention will become more apparent from the following detailed description when taken in conjunction with the accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention, and together with the description, serve to explain the principles of the invention.

DETAILED DESCRIPTION OF THE INVENTION

Figure 1:
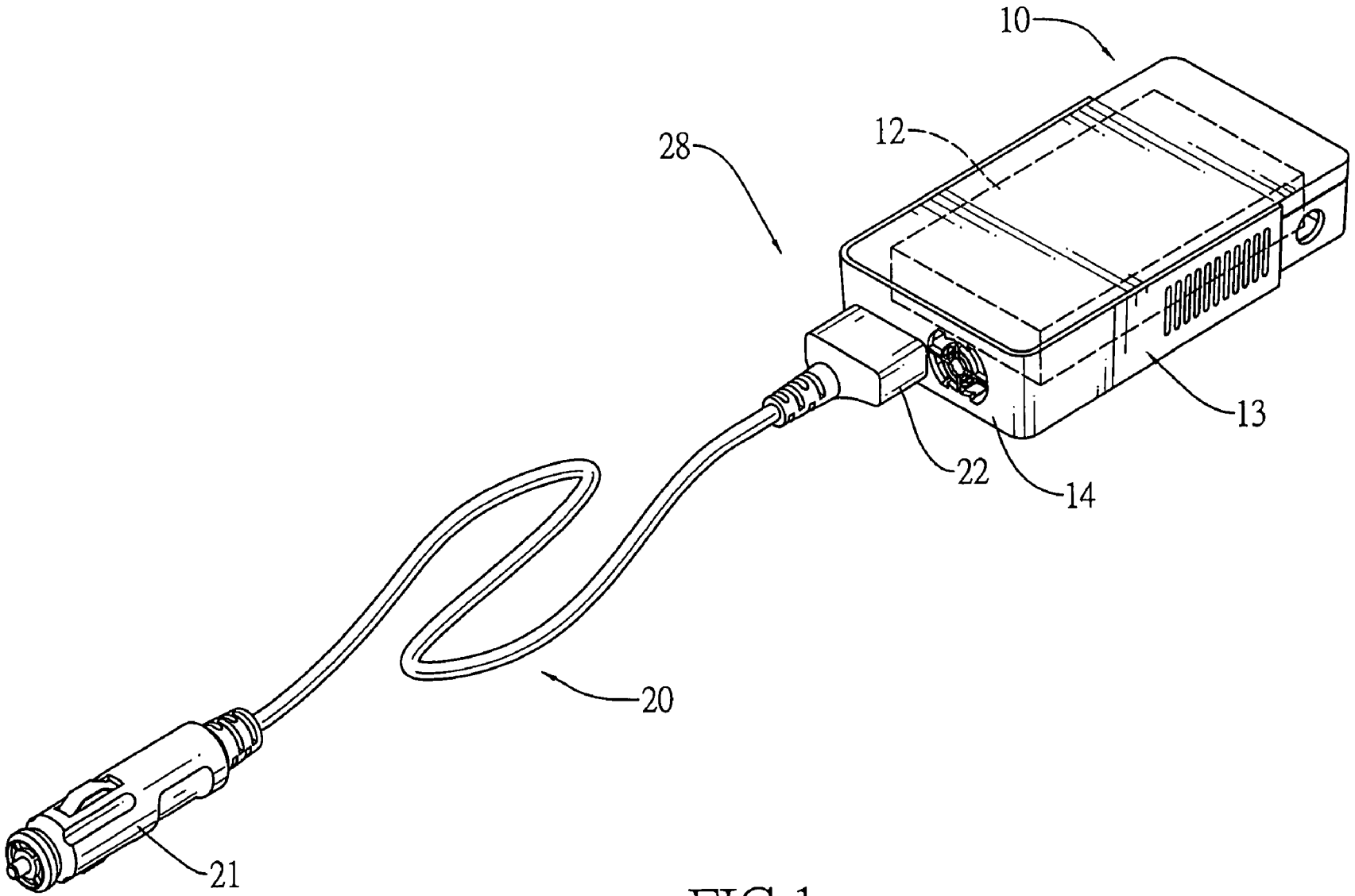
FIG. 1 is a perspective view of a DC/AC adapter assembly in accordance with an embodiment the present invention.
Figure 2:
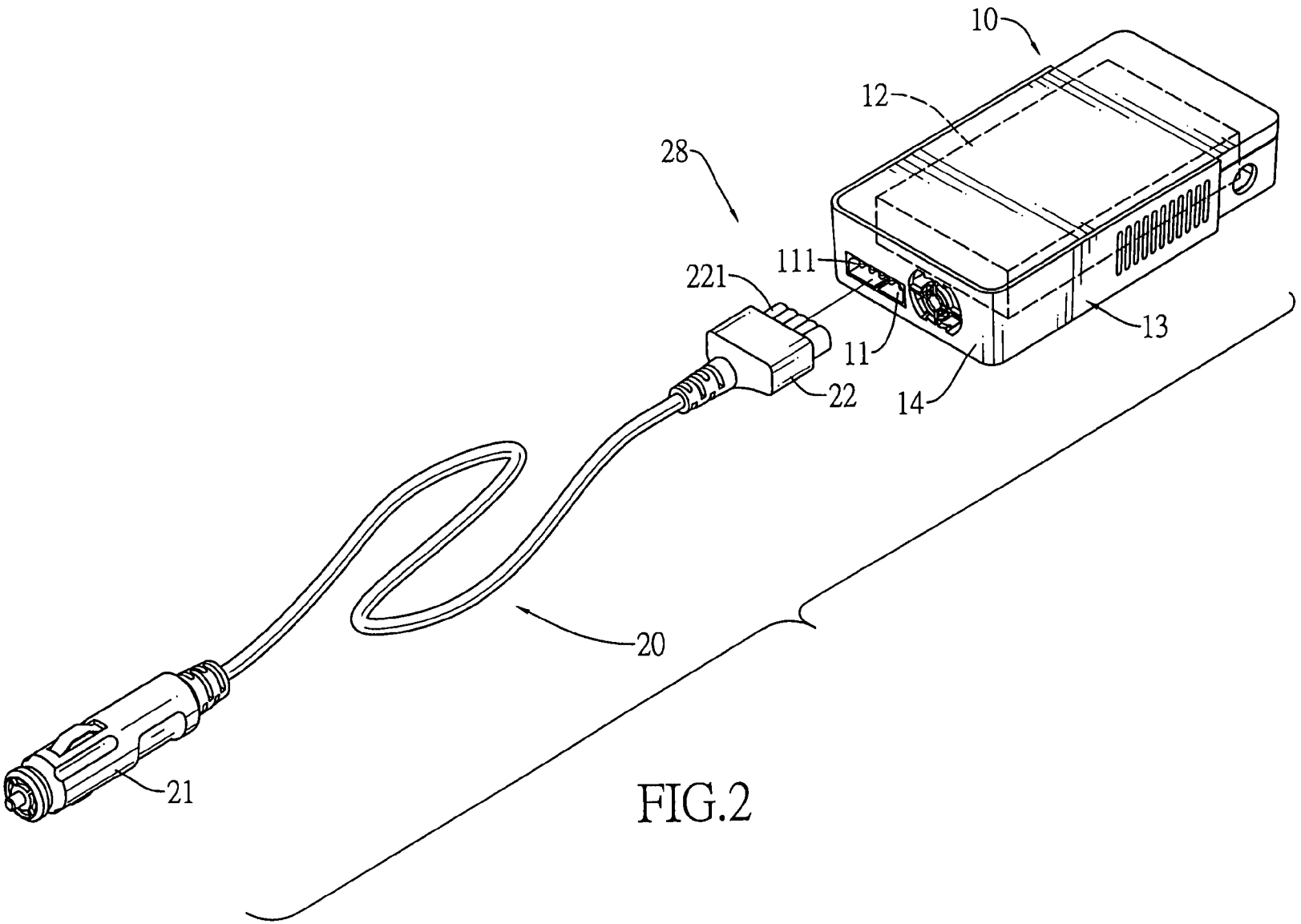
FIG. 2 is an exploded perspective view of the DC/AC adapter assembly in FIG. 1.
Figure 5:
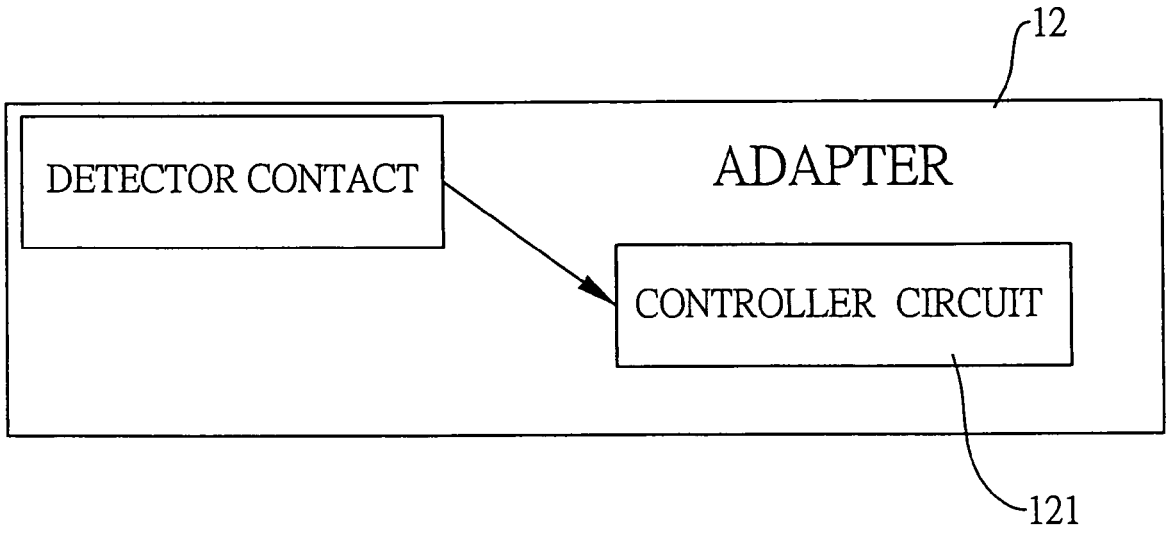
FIG. 5 is a diagram of a detector contact and a DC/AC adapter of a DC/AC adapter assembly in accordance with an embodiment of the present invention.
Figure 6:
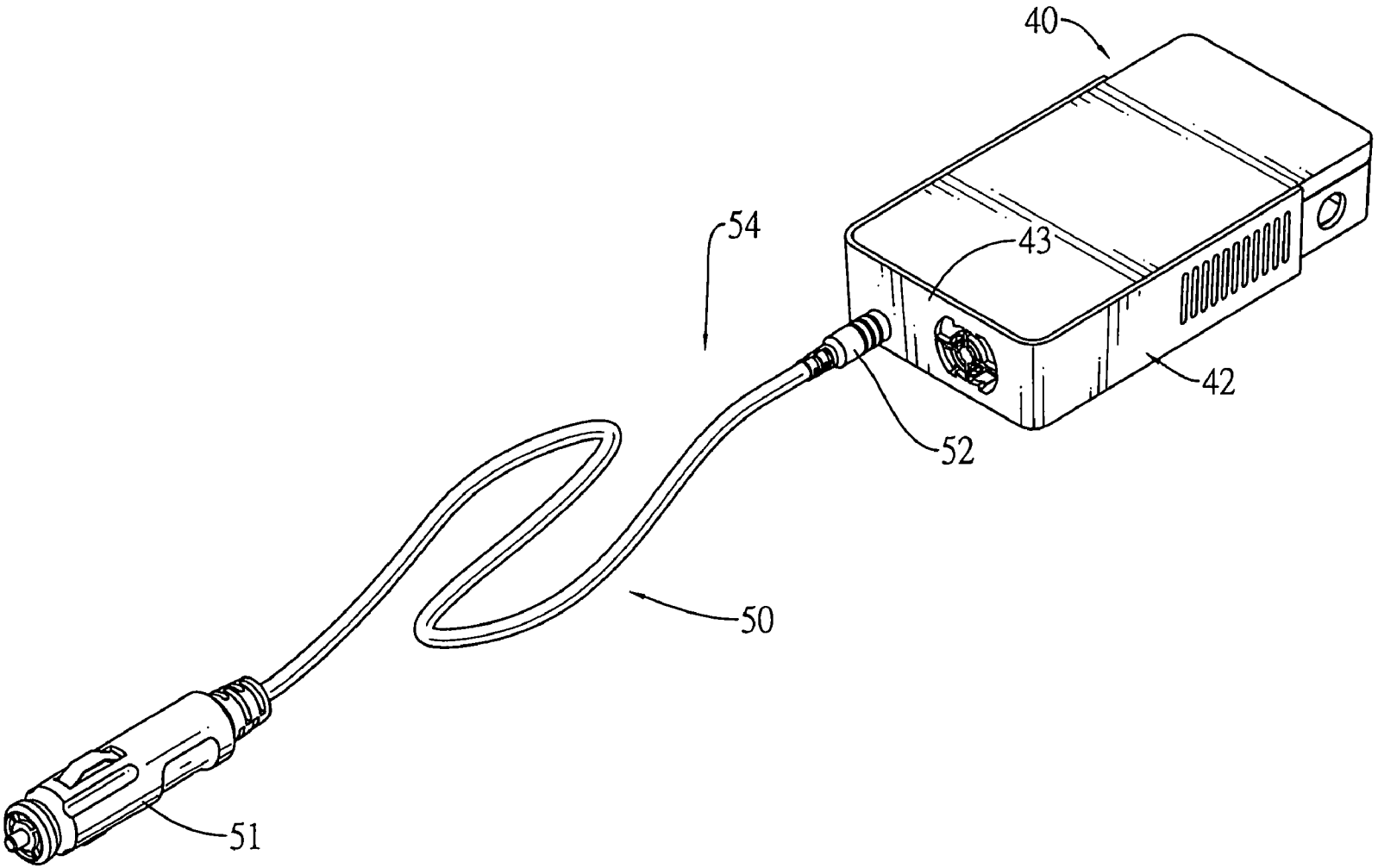
FIG.6 PRIOR ART
FIG. 6 is a perspective view of a conventional DC/AC adapter assembly in the prior art.
Figure 7:
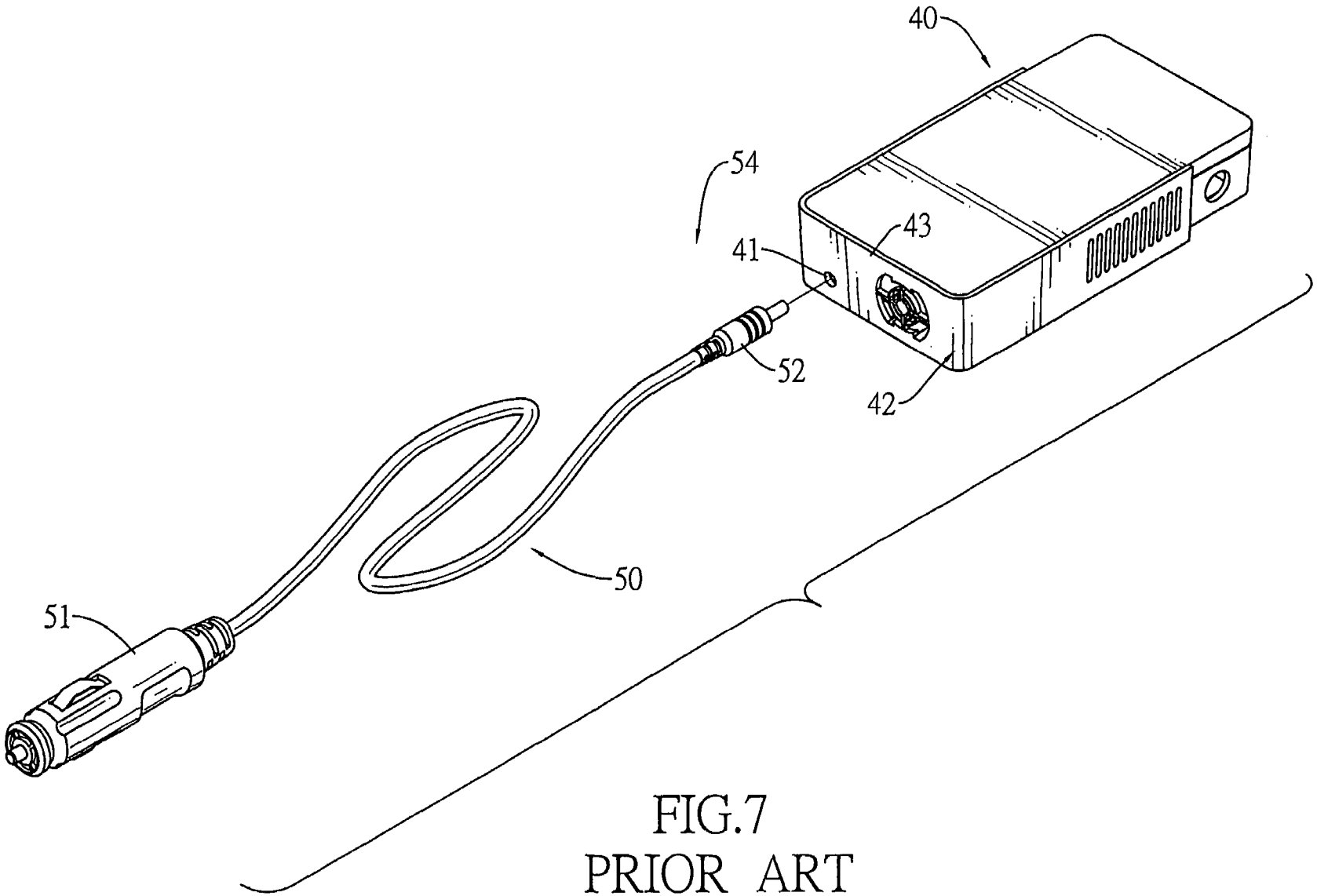
FIG.7 PRIOR ART
FIG. 7 is an exploded perspective view of the conventional DC/AC adapter assembly in FIG. 6.
Figure 8:
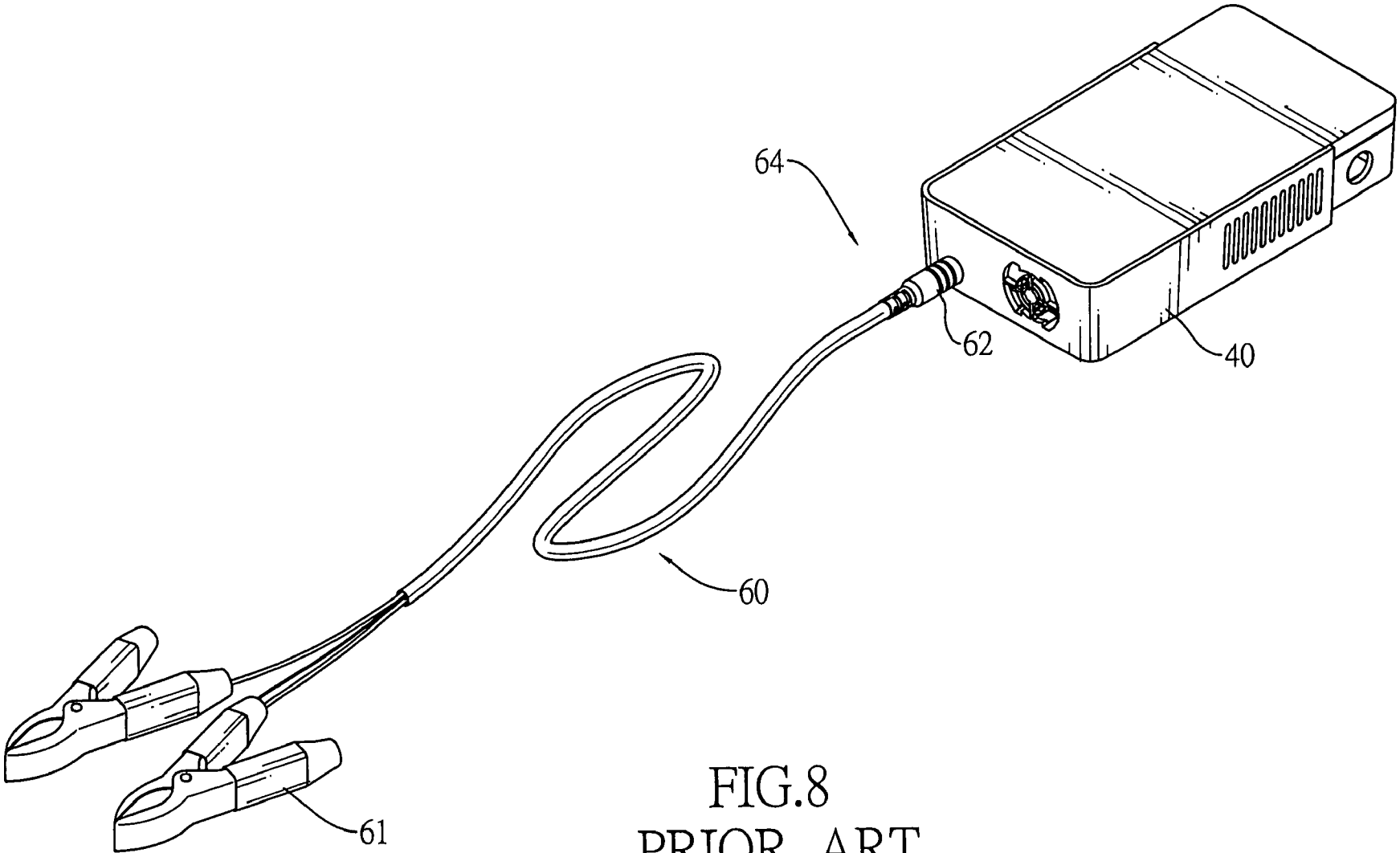
FIG.8 PRIOR ART
FIG. 8 is a perspective view of a conventional DC/AC adapter assembly in the prior art.
Figure 9:
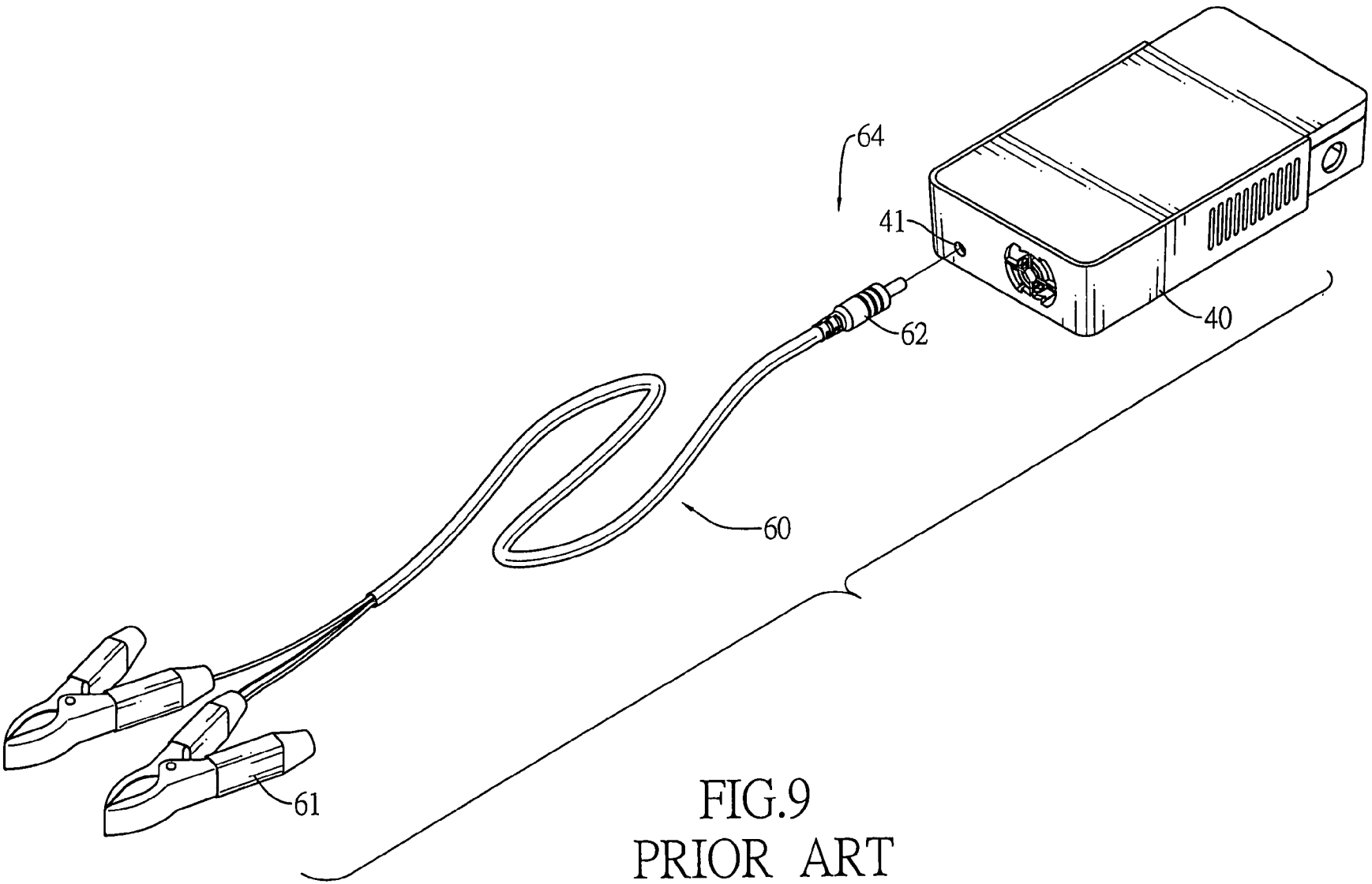
FIG.9 PRIOR ART
FIG. 9 is an exploded perspective view of the conventional DC/AC adapter assembly in FIG. 8.

FIGS. 1 and 2 illustrate a DC/AC adapter assembly 28, in accordance with an embodiment of the present invention. The DC/AC adapter assembly 28 has a DC/AC adapter 10 and a cable 20. The DC/AC adapter 10 receives input electricity through the cable 20. In various embodiments, the DC/AC adapter 10 is configurable to receive electrical power of up to 150-watts through the cable 20. The DC/AC adapter 10 has an enclosure 13 having a side 14 and includes a circuit board 12 and a socket 11. The circuit board 12 is mounted in the DC/AC adapter 10 for transforming a direct current (DC) input to the DC/AC adapter 10 to an alternating current (AC) (110V/220V) output from the DC/AC adapter 10. As illustrated in FIG. 5, the adapter 12 further includes a controller circuit 121 for controlling and adjusting the output alternating current of the DC/AC adapter 10. In one embodiment, the controller circuit 121 is mounted on the circuit board 12.

The socket 11 is mounted in the side 14 of the enclosure 13 and includes contacts 111. The contacts 111 are mounted in the socket 11 and are connected with the circuit board 12. One of the contacts 111 is connected with the controller circuit 121 for transmitting a power-overloading signal from the cable 20 to the controller circuit 121. In one embodiment, the contact 111 that transmits the power-overloading signal to the controller circuit 121 is a detector contact.

The cable 20 is used to connect the DC/AC adapter 10 to a power source, such as a cigarette lighter output of an automobile. The cable 20 has a proximal end and a distal end, and includes a connector 21 mounted to the proximal end for connecting the cable 20 to the power source. In one embodiment, the connector 21 is a cigarette lighter connector for connecting the cable 20 to a cigarette lighter outlet of an automobile. The cable 20 further includes a plug 22 mounted at the distal end of the cable 20 for connecting the cable 20 to the socket 11. When connected to the socket 11, the plug 22 transmits a power-overloading signal from the cable 20 to the socket 11. The power-overloading signal indicates whether power-overloading is occurring in the cable 20.

The plug 22 has contacts 221 corresponding to the contacts 111 of the socket 11. The contacts 221 of the plug 22 are configured to allow the contacts 111 of the socket 11 to plug into the contacts 221 of the plug 22 such that the contacts 221 of the plug 22 contact the respective contacts 111 of the socket 11. One of the contacts 221 of the plug 22 is configured to allow one of the contacts 111 of the socket 11 to plug into that contact 221 for transmitting the power-overloading signal from the cable 20 to DC/AC adapter 10. In one embodiment, each of contacts 111 and 221 that transmit the power-overloading signal from the cable 20 to the DC/AC adapter is a detector contact. Although the socket 11 has five contacts 111 and the plug 22 has five contacts 221 in the embodiment illustrated in FIGS. 1 and 2, the socket 11 may have more or fewer than five contacts 111 and the plug 22 may have more or fewer than five contacts 211 in other embodiments.

Figure 3:
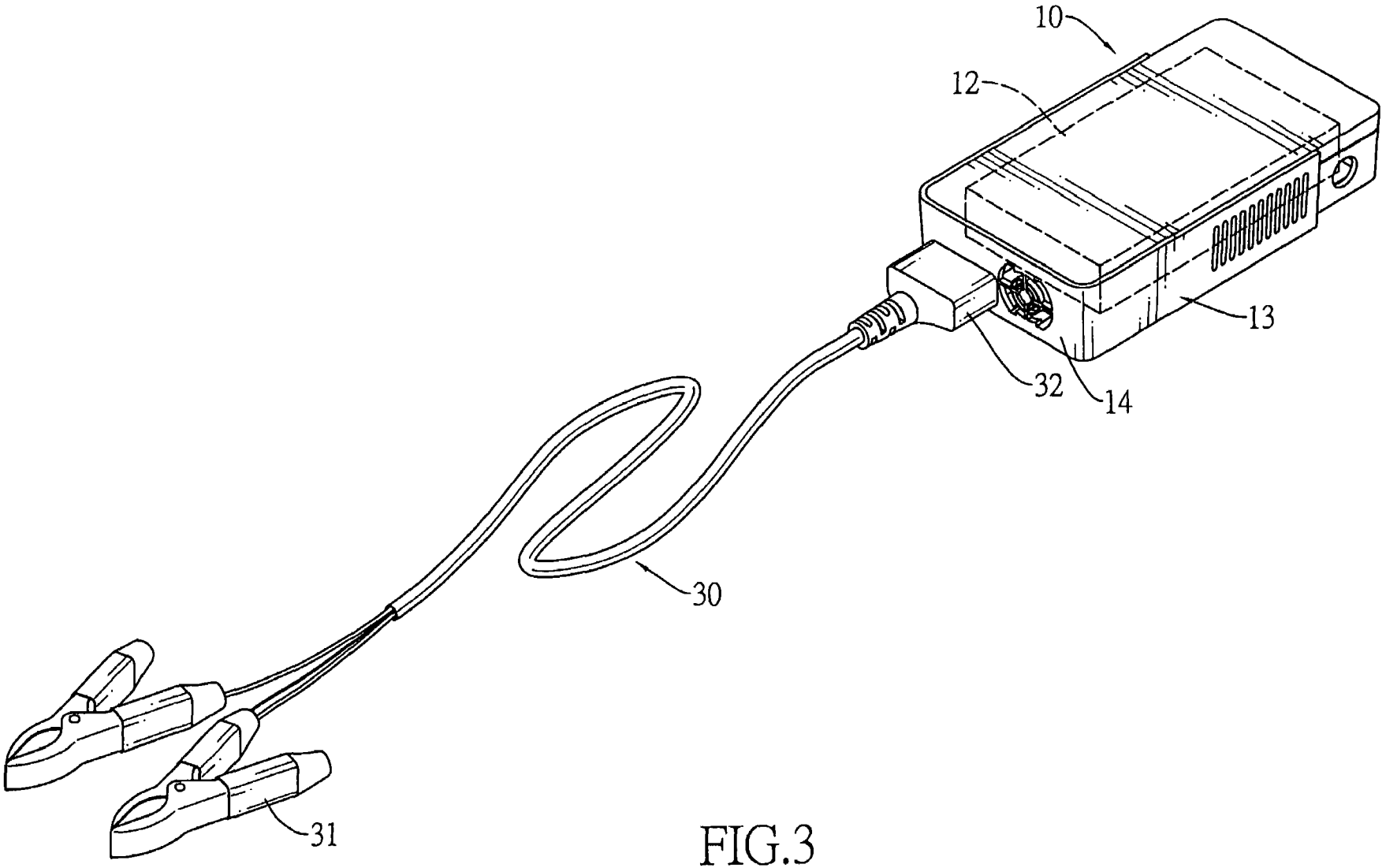
FIG. 3 is a perspective view of a DC/AC adapter assembly in accordance with an embodiment of the present invention.
Figure 4:
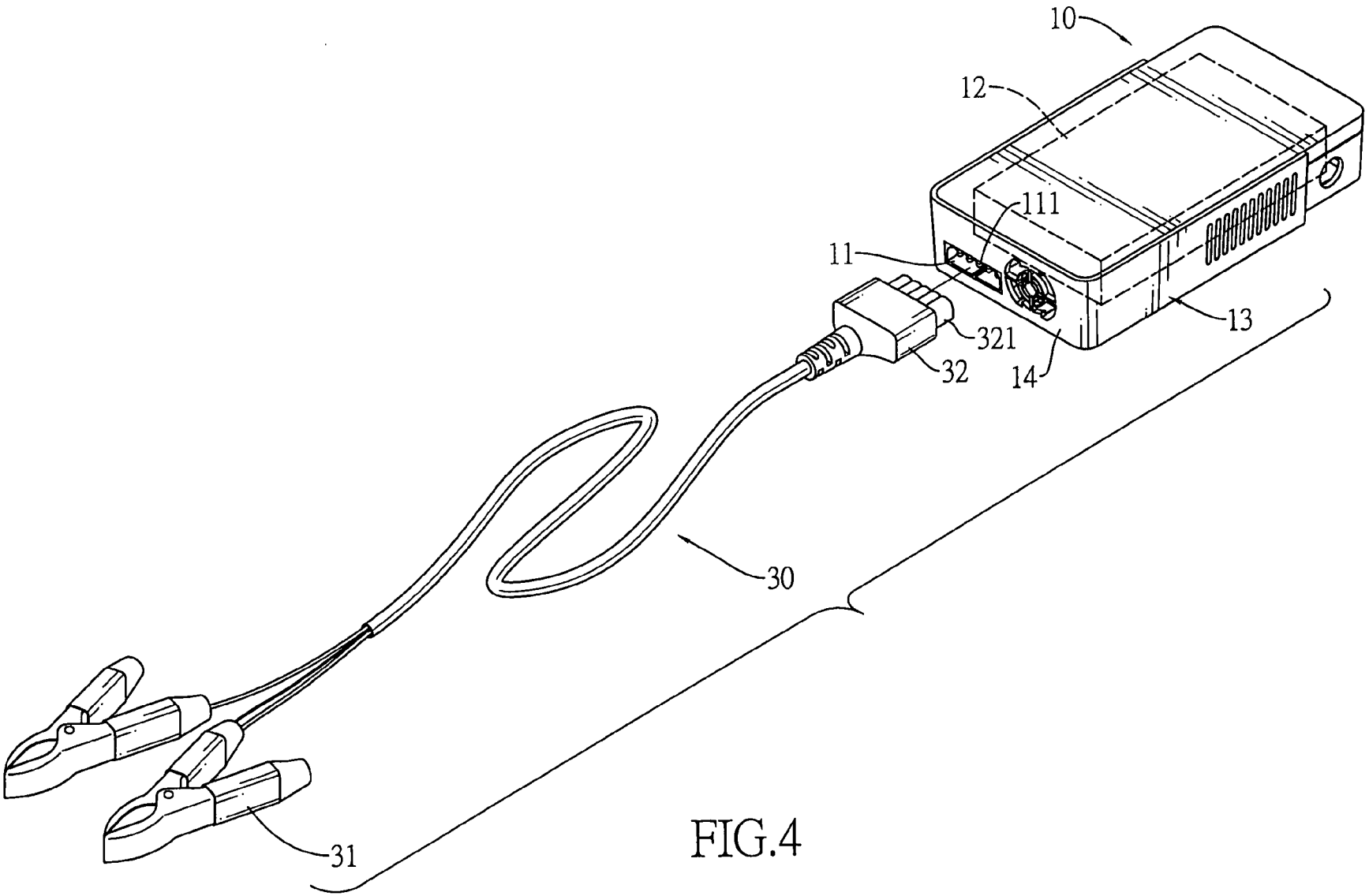
FIG. 4 is an exploded perspective view of the DC/AC adapter assembly in FIG. 3.

FIGS. 3 and 4 illustrate a DC/AC adapter assembly 38, in accordance with another embodiment of the present invention. The DC/AC adapter assembly 38 includes the DC/AC adapter 10 and a cable 30. The DC/AC adapter 10 receives input electricity through the cable 30. In various embodiments, the DC/AC adapter 10 is configurable to receive electrical power of up to 200-watts from the cable 30. The cable 30 is configured to connect the DC/AC adapter 10 to a power source, such as an automotive battery. The cable 30 has a proximal end and a distal end, and includes a connector 31 mounted at the proximal end of the cable 30. In one embodiment, the connector 31 comprises two crocodile clips for connecting the cable 30 to an automotive battery.

The cable 30 further includes a plug 32 mounted at the distal end of the cable 30 for connecting the cable 30 to the socket 11. When connected to the socket 11, the plug 32 transmits a power-overloading signal from the cable 30 to the socket 11. The power-overloading signal indicates whether power-overloading is occurring in the cable 30.

The plug 32 has contacts 321 corresponding to the contacts 111 of the socket 11. The contacts 321 of the plug 32 are configured to allow the contacts 111 of the socket 11 to plug into the respective contacts 321 of the plug 32 such that the contacts 321 of the plug 32 contact the respective contacts 111 of the socket 11. One of the contacts 321 of the plug 32 is configured to allow one of the contacts 111 of the socket 11 to plug into that contact 321 for transmitting the power-overloading signal from the cable 30 to the DC/AC adapter 10. In one embodiment, each of the contacts 111 and 321 that transmits the power-overloading signal from the cable 30 to the DC/AC adapter 10 is a detector contact.

Although the socket 11 has five contacts 111 and the plug 32 has five contacts 221 in the embodiment illustrated in FIGS. 3 and 4, the socket 11 may have more or fewer than five contacts 111 and the plug 32 may have more or fewer than five contacts 321 in other embodiments.

In operation, if the plug 22 of the cable 20 is plugged into the socket 11 of the DC/AC adapter 10 and the connector 21 is connected to a cigarette lighter outlet of an automobile, an excessive current may flow through the cable 20 causing power-overloading in the cable 20. The plug 22 transmits a power-overloading signal indicating whether power-overloading is occurring in the cable 20 to the socket 11. In one embodiment, the power-overloading signal indicates whether the input direct current flowing through the cable 20 exceeds an input current threshold. In another embodiment, the power-overloading signal indicates whether the electrical power flowing through the cable 20 exceeds a predetermined maximum power load of the cable 20. The DC/AC adapter 10 receives the power-overloading signal from the plug 22 and transmits the power-overloading signal to the controller circuit 121. In response to the power-overloading signal received from the DC/AC adapter 10, the controller circuit 121 adjusts the output current of the DC/AC adapter 10 to reduce the input direct current flowing through the cable 20. In this way, power-overloading is inhibited in the cable 20 and in the DC/AC adapter 40.

Although numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

Although the invention has been described with reference to particular embodiments thereof, it will be apparent to one of ordinary skill in the art that modifications to the described embodiments may be made without departing from the spirit of the invention. Accordingly, the scope of the invention will be defined by the attached claims not by the above detailed description.

What is claimed is:

1. A DC/AC adapter assembly having a DC/AC adapter having a circuit board mounted in the adapter and having a controller circuit mounted on the circuit board and configured to control and adjust an output current of the DC/AC adapter; and a socket mounted in the adapter and having a first plurality of contacts aligned in the socket, connecting with the circuit board and one of the contacts of the first plurality of contacts being a detector contact that connects with the controller circuit;

a cable configured to connect to the adapter and adapted to connect to a power source, the cable having a distal end and a plug mounted at the distal end of the cable and configured to detachably plug into the socket, send a power-overloading signal to the socket when an electric power of the electricity in the cable exceeds a predetermined maximum load, the plug having a second plurality of contacts corresponding to the first plurality of contacts and configured to contact the first plurality of contacts, a detector contact of the second plurality of contacts configured to contact the detector contact of the first plurality of contacts for transmitting the power-overloading signal from the cable to the socket when the electric power of the electricity in the cable exceeds the predetermined maximum load; and a proximal end having a connector and configured to connect to the power source.

2. The DC/AC adapter assembly as claimed in claim 1, wherein the connector of the proximal end of the cable is a cigarette lighter connector.

3. The DC/AC adapter assembly as claimed in claim 1, wherein the connector of the proximal end of the cable comprises two crocodile clips.

4. A DC/AC adapter assembly comprising:

a DC/AC adapter comprising a controller circuit configured to control an output alternating current of the DC/AC adapter and a socket electrically connected to the controller circuit and comprising a first plurality of contacts; and a cable configured to connect to the DC/AC adapter and to a power source, the cable further configured to transmit electrical power from the power source to the AC/DC adapter and to transmit a signal to the DC/AC adapter indicating whether power-overloading is occurring in the cable, the controller circuit further configured to adjust the output alternating current based on the signal, the cable comprising a connector configured to connect to the power source for receiving an input direct current; and a plug for plugging the cable into the socket, the plug configured to transmit the signal to the socket and comprising a second plurality of contacts corresponding to the first plurality of contacts, the first plurality of contacts configured to contact the second plurality of contacts when the plug is plugged into the socket;

wherein one of the first plurality of contacts is a detector contact and one of the second plurality of contacts is a detector contact, and the detector contact of the first plurality of contacts is configured to contact the detector contact of the second plurality of contacts when the plug is plugged into the socket.

5. The DC/AC adapter assembly of claim 4, wherein the detector contact of the first plurality of contacts is configured to transmit the signal from the cable to the detector contact of the second plurality of contacts.

6. The DC/AC adapter assembly of claim 4, wherein the first plurality of contacts comprises five contacts and wherein the second plurality of contacts comprises five contacts.

7. The DC/AC adapter assembly of claim 4, wherein the connector is a cigarette lighter connector.

8. The DC/AC adapter assembly of claim 4, wherein the connector comprises two crocodile clips.

9. The DC/AC adapter assembly of claim 4, wherein the signal indicates whether the input direct current exceeds a predetermined input current threshold.

10. A DC/AC adapter assembly comprising:

a DC/AC adapter comprising a controller circuit configured to control an output alternating current of the DC/AC adapter and a socket electrically connected to the controller circuit and comprising a first plurality of contacts; and a cable configured to connect to the DC/AC adapter and adapted to connect to a power source, the cable further configured to transmit an input direct current from the power source to the AC/DC adapter and to transmit a signal to the DC/AC adapter based on the input direct current, the signal indicating whether the input direct current exceeds an input current threshold, the controller circuit further configured to adjust the output alternating current based on the signal to reduce the input direct current, the cable comprising a connector configured to connect to the power source for receiving the input direct current; and a plug for plugging the cable into the socket, the plug configured to transmit the signal to the socket and comprising a second plurality of contacts corresponding to the first plurality of contacts, the first plurality of contacts configured to contact the second plurality of contacts when the plug is plugged into the socket;

wherein a first contact of the first plurality of contacts is configured to contact a second contact of the second plurality of contacts for transmitting the signal from the plug to the socket.

11. The DC/AC adapter assembly of claim 10, wherein the first plurality of contacts comprises five contacts and wherein the second plurality of contacts comprises five contacts.

12. The DC/AC adapter assembly of claim 10, wherein the connector is a cigarette lighter connector.

13. The DC/AC adapter assembly of claim 10, wherein the connector comprises two crocodile clips.

14. The DC/AC adapter assembly of claim 10, wherein the signal indicates whether power-overloading is occurring in the cable.

* * * * *